US005440889A

United States Patent [19]

Sippel et al.

[11] Patent Number: 5,440,889

[45] Date of Patent: Aug. 15, 1995

[54] METHOD OF AND ARRANGEMENT FOR COOLING OF HOT ROLLED SECTIONS IN PARTICULAR RAILS

[75] Inventors: Egon Sippel, Niederkrüchten; Meinert Meyer, Erkrath; Manfred Albedyhl, Mettmann; Friedrich Hollmann, Grevenbroich, all of Germany

[73] Assignee: SMS Schloemann-Siemag AG, Düsseldorf, Germany

[21] Appl. No.: 151,706

[22] Filed: Nov. 12, 1993

[30] Foreign Application Priority Data

Nov. 11, 1992 [DE] Germany ..... 42 37 991.1

[51] Int. Cl.[6] ..... F25D 13/06

[52] U.S. Cl. ..... 62/63; 72/201

[58] Field of Search ..... 62/63, 373, 374; 72/201

[56] References Cited

U.S. PATENT DOCUMENTS

| | | | |
|---|---|---|---|
| 2,087,346 | 7/1937 | Johnson | 72/201 |
| 3,347,076 | 10/1967 | Noda et al. | 72/201 |
| 3,659,428 | 5/1972 | Kunioaka et al. | 62/64 |
| 3,718,007 | 2/1973 | Randrup | 62/63 |
| 4,033,737 | 7/1977 | Kunioka et al. | 62/64 |
| 4,541,251 | 9/1985 | Louradour et al. | 62/64 |

FOREIGN PATENT DOCUMENTS

| | | | |
|---|---|---|---|
| 902397 | 6/1972 | Canada | 72/201 |
| 2320745 | 11/1974 | Germany | 72/201 |
| 0150701 | 7/1986 | Japan | 72/201 |

*Primary Examiner*—Ronald C. Capossela
*Attorney, Agent, or Firm*—Anderson Kill Olick & Oshinsky

[57] ABSTRACT

A method for cooling of profiled rolled material hot rolled in roll stands, especially rails on a cooling bed by natural convection or by forced air cooling, which includes conveying the rails across the cooling bed with the rail heads oriented downwards. The apparatus for effecting the method includes a cooling bed having support elements which support the rails in a suspended state with the rail heads oriented downwards.

5 Claims, 5 Drawing Sheets

METHOD OF AND ARRANGEMENT FOR COOLING OF HOT ROLLED SECTIONS IN PARTICULAR RAILS

BACKGROUND OF THE INVENTION

The invention relates to a method of cooling profiled rolling products hot rolled in rolling stands, especially rails on a cooling bed by natural convection or force air cooling. The invention is also directed to an apparatus for performing the above-mentioned method of cooling rails.

Rails are cooled on cooling beds down to a temperature below 80° C. Conventionally the rail lies on one of its sides with the head and flange on the cooling panels, as shown in FIG. 1. Because of the asymmetrical profile, different cooling behavior occurs between the head and the flange of the rail. The flange cools faster than the head with the result that the cooled rail is warped. This warping can be countered to a certain degree by cambering of the still hot rail.

In any case, the cooled rail must be leveled or straightened. This is accomplished on especially equipped leveling machines. Residual stresses are set up in the rails by the cooling process and particularly by the leveling process, which can lead to a scrapping of the rail in case of unfavorable development.

Thus it is desirable to keep the residual stresses arising in the course of leveling at a reduced level, by feeding as "straight" rails as possible to the leveling machine, for instance, by cambering the rails.

Accordingly, it is an object of the present invention to provide a cooling process for hot rolled profiled rolling products, especially for rails, by which the rail can be cooled so that it is free of warping to the extent possible, and which makes it possible to minimize the residual stresses generated especially in the subsequent leveling process in the leveling machine. Another object of the present invention is to provide an apparatus for effecting the inventive process.

SUMMARY OF THE INVENTION

The object of the invention is achieved by providing a cooling process in which the rails are conveyed across the cooling bed in a suspended state with the head downwards. Due to this measure, the heat transfer conditions are changed in a favorable way already by natural convection, so that the temperature difference between the head and the flange of the rail is reduced from 140° C. with the rail in the horizontal state down to 50° C. with the rail suspended. Because of the small temperature difference between the head and the flange, the disadvantages of warping of the rail described above are avoided, and it is achieved that a nearly straight rail is introduced into the leveling machine for finish-leveling, whereby the residual stresses in the rail material can be kept very small.

The above-mentioned lower temperature difference of 50° C. between the rail head and the rail flange can be further reduced if the rail head is additionally cooled with adjustable flow of a medium or with a mixture of cooling media, preferably with air or an air/-water mixture. The cooling process can be still further improved and the temperature difference across the cross-section of the rail can be further lowered, if according to an additional refinement of the invention, the rail is cooled across its entire length by an adjustable flow of medium or a mixture of cooling media, so that the rail head and the rail flange are cooled at different intensities. It is advantageous if the rail head and/or the rail flange is acted upon by the cooling medium or the mixture of cooling media in such a way that a cooling speed of 0.5° C. per second to 20° C. per second can be selected. The cooling method of the invention, especially cooling with the cooling speed of 0.5° C. per second to 20° C. per second can advantageously be used for rails which are rolled at a finish-rolling temperature of 540° C. to 900° C.

The apparatus for performing the cooling method of the invention is distinguished by a cooling bed comprising support elements which support the rail with its head suspended downwards. The support elements are expediently designed to be U-shaped towards the top, so that the rail flange can be placed upon the legs of the U-shaped support elements, and the rail head extends downwards into the U-shaped recess. Advantageously, the support elements are interconnected to form a chain-type cooling bed with the support elements being spaced from each other along the longitudinal axis of the rail, preferably, at a distance of 2 to 6 m.

According to another embodiment of the invention, the support elements, when a walking beam type cooling bed is used, extend into the walking beam and form a recess there, which is wider than the rail head but smaller than the rail flange, so that the rail can be placed head downwards into the recess, and the rail flange extends sideways in the recess. It is further proposed, for an improved adjustability of the targeted cooling of the head and the flange of the rails, to provide nozzle-shaped medium distribution elements with measuring and regulating organs, as well as mixing valves for the cooling medium or for the mixture of cooling media. The distribution elements can be oriented in the targeted and adjustable manner to the rail head and/or the rail flange.

BRIEF DESCRIPTION OF THE DRAWING

The features and objects of the present invention will become more apparent, and the invention itself will be best understood from the following detailed description of the preferred embodiment when read with reference to the appended drawings, wherein.

DETAILED DESCRIPTION OF THE PREFERRED EMBODIMENT

Figure 1:
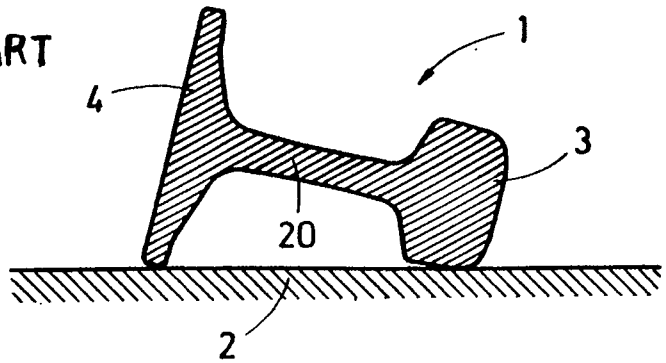
FIG.1 PRIOR ART
FIG. 1 is a cross-sectional view of a rail disposed horizontally upon a cooling bed.

FIG. 1 shows a portion of a cooling bed 2, on which the rail 1 rests on its side with a head 3 and a flange 4 upon the cooling bed rake. It can be seen that a different cooling behavior must arise between the head 3 and the flange 4 of the rail 1 because of an asymmetrical profile.

The flange 4 cools faster than the head 3 not lastly because of the different material distribution with the result that the cooled rail 1 warps. In a subsequent leveling process, the rail must then be again leveled and, as a result, residual stresses are set up in the material of the rail, which residual stresses can result in an unfavorable shape and consequently scrapping of the rail.

The disadvantages described above are avoided by using a new cooling method and apparatus of the present invention wherein the cooling bed for hot rolled rails is reshaped in such a way, that the rails are conveyed across the cooling bed in a suspended state with the head downwards. For this purpose, the cooling bed 2 is provided with support elements 5, into which the rails 1 can be suspended head downwards.

Figure 2:
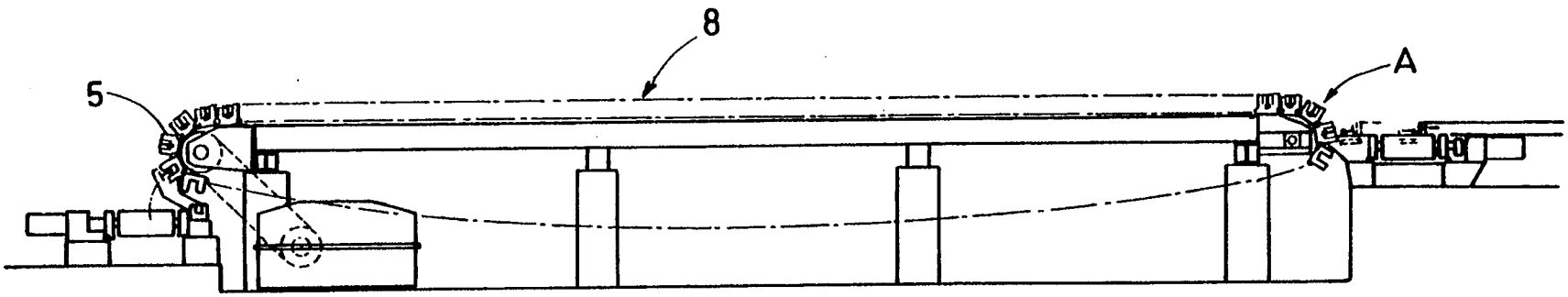
FIG. 2 is a schematic view of a chain type cooling bed with support elements for the rail according to the present invention.

FIG. 2 shows a chain-type cooling bed 8, where the support elements 5 are interconnected and are spaced from each other along the longitudinal axis of the rail 1 so as to have preferably a spacing distance of 2 to 6 m in longitudinal direction of the rail. The support elements 5 are essentially U-shaped and open towards the top. The rail flange 4 can be placed upon the legs 6 of the U-shaped profile, so that the rail head 3 extends downwards into the U-shaped recess 7.

Figure 3:
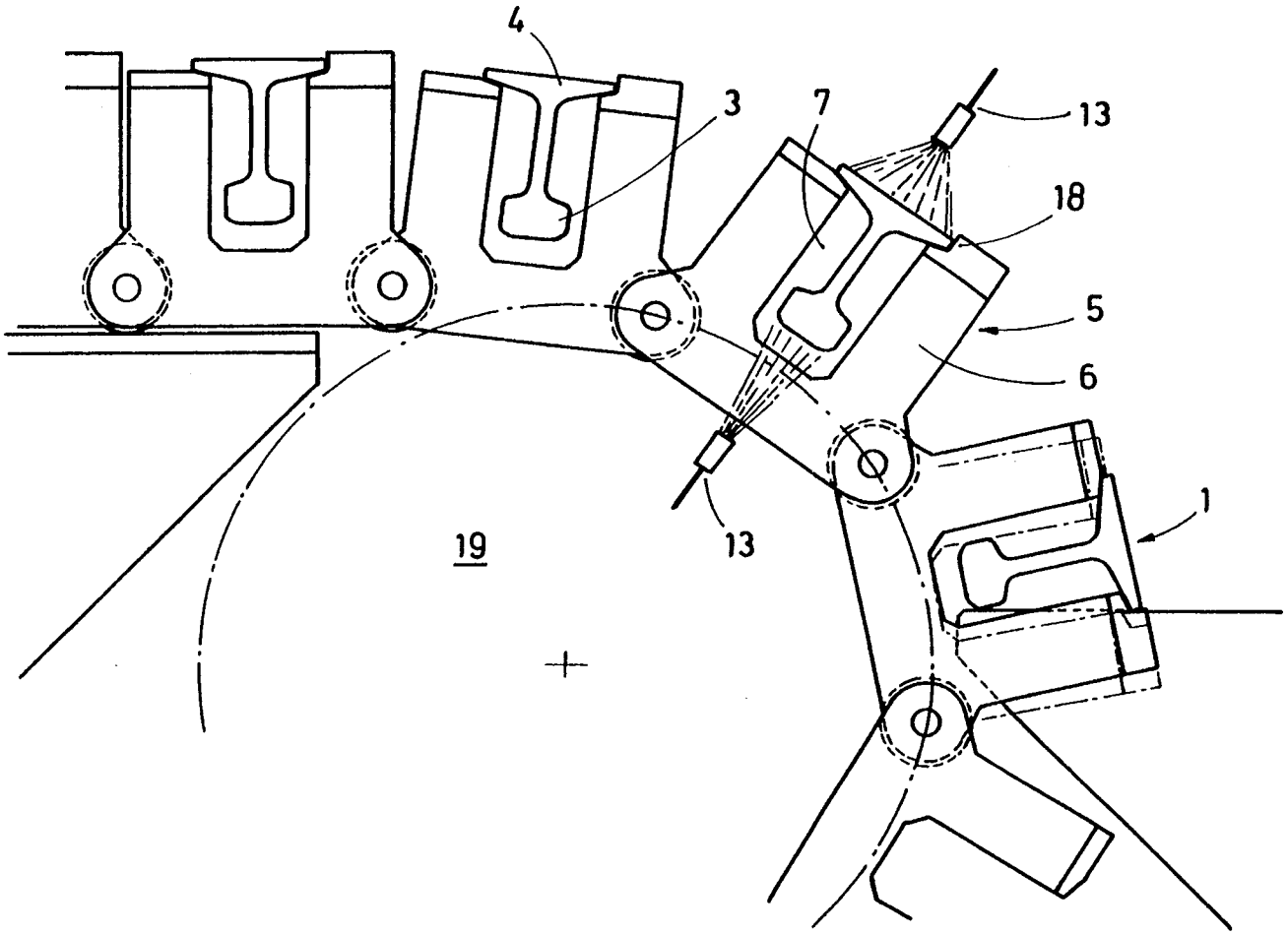
FIG. 3 is an enlarged partial view of a portion A of the cooling bed shown in FIG. 2.

FIG. 3 shows a portion A of the FIG. 2 with the U-shaped support elements 5 which are interconnected to form a chain. The legs 6 of the support elements 5 are matched to the shape of the rail flange 4, with the rail flange abutting one side against a shoulder 18 in order to orient the rail centrally in the U-shaped recess 7.

Figure 4:
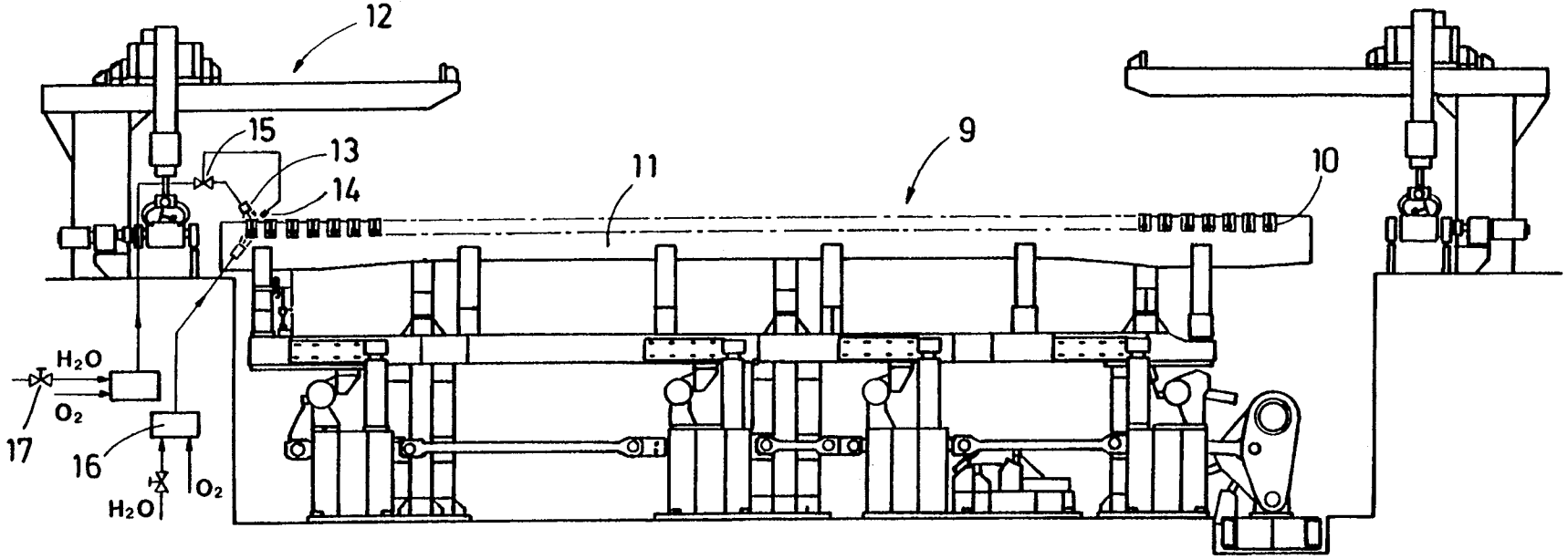
FIG. 4 is a schematic view of a walking beam cooling bed according to the present invention with recesses for suspending the rails by a crane.

FIG. 4 shows a walking beam type cooling bed 9, wherein the support elements 5 are formed by providing recesses 10 in the walking beam 11 with the rails 1 being suspended in the recesses 10 in such a way that they are transported across the cooling bed 2 with the head 3 suspended downwards. The recess 10 defines the support element and is shaped in such a way that it is wider than the rail head 3, however smaller than the rail flange 4, so that the rail flange can be placed sideways of the recess 10 upon the walking beam 11. The rail 1 is placed into the support element 5 (recess 10) in the walking beam 11 by a crane 12.

A nozzle-like distribution element 13 is provided with measuring and regulation organs (temperature sensor/-control valves 14, 15), and mixing valves 16 are provided for the cooling medium ($O_2$) or for the mixture of cooling media ($H_2O$ and $O_2$). The elements 13 can be aligned in a targeted and adjustable manner relative to the rail head 3 and/or the rail flange 4. These measures permit then to cool the rail head and the rail flange in a targeted and controlled manner. The possibility is provided to cool the rail across its entire length by an adjustable flow of medium or a mixture of cooling media, wherein however the rail head and the rail flange are cooled at different intensities. The controlled adjustability of the cooling medium permits to apply the cooling medium to the rail head 3 and/or to the rail flange 4 with a cooling speed of 0.5° C./sec to 20° C./sec. This speed is particularly used for rails which are rolled in the roll stand with an end rolling temperature of 540° C. to 900° C.

Figure 5:
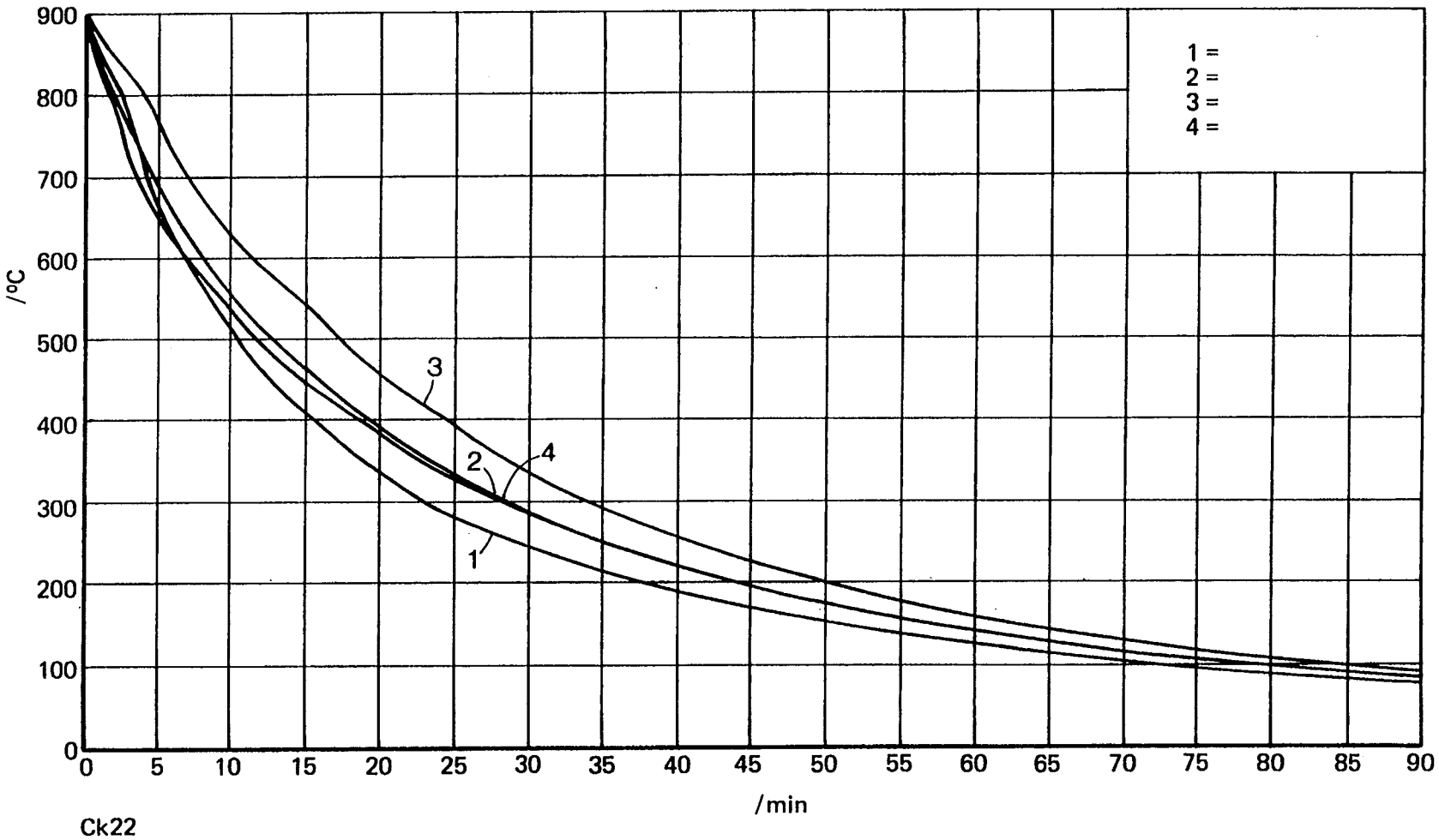
FIG. 5 is a temperature-/time diagram of the cooling process for a rail in a horizontal position shown in FIG. 1.

FIG. 5 shows a temperature/time diagram of the cooling behavior of the rail disposed conventionally upon the cooling bed (FIG. 1) and cooled by natural convection and having a finish-rolling temperature of 900° C. A large temperature difference of approximately 140° C. between rail head (line 3) and rail flange (line 1) is clearly visible, which results in the disadvantages explained previously.

Figure 6:
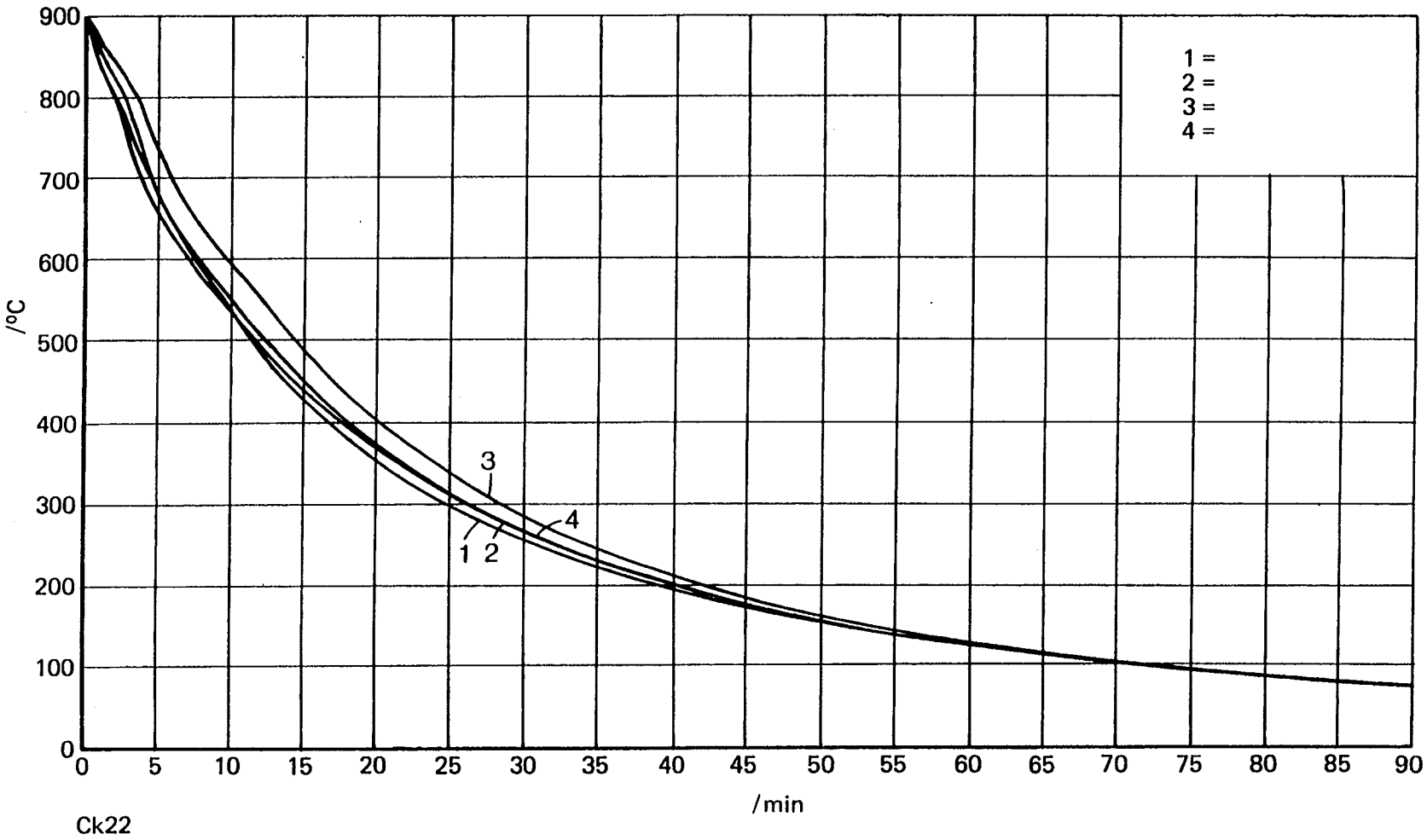
FIG. 6 is a temperature-/time diagram of the cooling process of a suspended rail shown in FIG. 3.

FIG. 6 shows a temperature-/time diagram of the cooling process according to the invention for a rail with a finish- rolling temperature of 900° C. and cooled by natural convection, with the rail being conveyed across the cooling bed suspended head downwards. The temperature difference between rail head (line 3) and rail flange (line 1) amounts now only to approximately 50° C.

The above-described method of cooling of rails hot rolled in roll stands in an appropriately designed cooling bed permits to reduce the temperature difference between the rail head and the rail flange to such an extent in the course of the cooling process that the warping of the rail caused by different thermal stresses can be avoided. This makes it possible to feed the rail nearly free of warping for a subsequent leveling process in a leveling machine, where only slight leveling is still necessary. Herein, on one hand, the residual stresses in the rail material are kept very small and, on the other hand, the smaller leveling machines can be used since only small leveling forces are to be exerted upon the rail.

What is claimed is:

1. An apparatus for cooling hot rolled rails, comprising a cooling bed, means for transporting the hot rolled rails along the cooling bed, and a plurality of support elements provided on the transporting means for supporting the hot rolled rails in a suspended state with rail heads of the hot rolled rails oriented downwardly.

2. An apparatus according to claim 1, wherein the support elements have essentially a U-shaped form open at the top and have spaced leg, which define a U-shaped recess and which support a rail flange, with the rail head oriented downwards into the U-shaped recess.

3. An apparatus according to claim 1, further comprising a nozzle-shaped medium distribution means including measuring and regulation elements and mixing valve means for a medium, wherein the distribution means are orientable in a targeted and adjustable manner relative to at least one of the rail head and the rail bottom flange.

4. An apparatus as set forth in claim 1, wherein the transporting means comprises a chain conveyor, and wherein the support elements are spaced from each other along a longitudinal axis of a rail by a distance of 2–6 m.

5. An apparatus according to claim 1, wherein the transporting means comprises a walking beam, and wherein the support elements comprises recesses formed in the walking beam and having a width wider than the rail head but narrower than a rail flange.

* * * * *